US007911314B2

(12) United States Patent
Dauth et al.

(10) Patent No.: US 7,911,314 B2
(45) Date of Patent: Mar. 22, 2011

(54) ELECTRIC CIRCUIT WITH THERMAL-MECHANICAL FUSE

(76) Inventors: Alexander Dauth, Maulbronn (DE); Jürgen Paul, Stutensee (DE); Rolf Merte, Wiesloch (DE); Michael Luppold, Dettenheim (DE)

( * ) Notice: Subject to any disclaimer, the term of this patent is extended or adjusted under 35 U.S.C. 154(b) by 280 days.

(21) Appl. No.: 12/085,408

(22) PCT Filed: Jul. 21, 2007

(86) PCT No.: PCT/EP2007/006500

§ 371 (c)(1),
(2), (4) Date: May 22, 2008

(87) PCT Pub. No.: WO2008/025416

PCT Pub. Date: Mar. 6, 2008

(65) Prior Publication Data

US 2010/0045421 A1 Feb. 25, 2010

(30) Foreign Application Priority Data

Sep. 1, 2006 (DE) ..... 10 2006 041 123

(51) Int. Cl.
*H01H 37/76* (2006.01)

(52) U.S. Cl. ..... 337/407; 337/142; 337/401

(58) Field of Classification Search ..... 337/401, 337/407, 142

See application file for complete search history.

(56) References Cited

U.S. PATENT DOCUMENTS

| | | | | |
|---|---|---|---|---|
| 2,790,049 | A * | 4/1957 | McAlister | 337/405 |
| 3,198,914 | A * | 8/1965 | Baran et al. | 337/405 |
| 3,420,217 | A * | 1/1969 | Powell et al. | 123/198 D |
| 3,569,892 | A * | 3/1971 | Ripamonti | 337/320 |
| 3,613,040 | A * | 10/1971 | Fluder et al. | 337/282 |
| 3,629,766 | A * | 12/1971 | Gould, Jr. | 337/239 |
| 3,763,454 | A * | 10/1973 | Zandonatti | 337/404 |
| 3,827,014 | A | 7/1974 | Wehl | |
| 4,433,231 | A * | 2/1984 | Balchunas | 219/253 |
| 4,441,093 | A * | 4/1984 | Okazaki | 337/404 |
| 4,486,804 | A * | 12/1984 | Watson et al. | 361/104 |
| 4,536,641 | A * | 8/1985 | Chan | 219/253 |
| 5,192,937 | A * | 3/1993 | Lee | 337/104 |
| 5,280,262 | A * | 1/1994 | Fischer | 337/405 |
| 5,363,083 | A * | 11/1994 | Fischer | 337/407 |
| 5,612,662 | A * | 3/1997 | Drekmeier et al. | 337/389 |
| 5,770,993 | A | 6/1998 | Miyazawa et al. | |
| 5,793,274 | A * | 8/1998 | Kelly et al. | 337/183 |
| 5,896,080 | A * | 4/1999 | Chen | 337/407 |
| 5,982,270 | A * | 11/1999 | Wolfe et al. | 337/401 |
| 6,073,615 | A | 6/2000 | Anderson et al. | |
| 6,204,747 | B1 * | 3/2001 | Kitchens | 337/407 |
| 6,445,277 | B1 * | 9/2002 | Ishikawa et al. | 337/297 |

(Continued)

FOREIGN PATENT DOCUMENTS

DE 38 25 897 A1 2/1990

(Continued)

*Primary Examiner* — Anatoly Vortman

(57) ABSTRACT

A electric circuit includes a connection to a current source, an electric load, and a thermal-mechanical fuse which, in the case of failure at an excessive heat emission, interrupts the current supply to the load, which is effectuated by a feeder in which is arranged a spring having two ends, at least one end is soldered to a solder point provided in the feed line. The one solder point is under a mechanical pretension caused by the restoring force of a spring, that separates the solder joint between the spring and the solder point in the feed line, when the solder melts at the solder point.

14 Claims, 4 Drawing Sheets

U.S. PATENT DOCUMENTS

| | | | | |
|---|---|---|---|---|
| 6,614,341 | B2 * | 9/2003 | Martin | 337/297 |
| 6,875,962 | B2 | 4/2005 | Uhl et al. | |
| 7,023,674 | B2 * | 4/2006 | Gross et al. | 361/23 |
| 7,148,453 | B2 | 12/2006 | Bohlender et al. | |
| 7,345,570 | B2 * | 3/2008 | Kawanishi | 337/142 |
| 7,385,474 | B2 * | 6/2008 | Kawanishi | 337/142 |
| 7,639,114 | B2 * | 12/2009 | Yu | 337/405 |

FOREIGN PATENT DOCUMENTS

| | | | | |
|---|---|---|---|---|
| DE | 195 15 533 | A1 | | 11/1996 |
| DE | 100 49 030 | A1 | | 4/2002 |
| DE | 10 2004 014 660 | A1 | | 7/2005 |
| DE | 10 2005 005 549 | A1 | | 8/2006 |
| EP | 352771 | A | * | 1/1990 |

* cited by examiner

ELECTRIC CIRCUIT WITH THERMAL-MECHANICAL FUSE

The invention relates to an electric circuit wherein, in the case of a failure, a thermal-mechanical fuse interrupts the current supply to a load. Automobiles require such electric circuits. In automobiles are used electric heating devices such as, e.g., intake air heaters and additional heaters.

Intake air heaters are heating devices for the preheating of the intake air for internal combustion engines. By preheating the cold air to be taken in by the engine, they improve the combustion behavior and lower contaminant emission as well as gasoline consumption.

Modern diesel engines and Otto engines with direct fuel injection have a high thermal efficiency. This means that, comparatively, they do not generate much waste heat for the heating of the passenger compartment of the vehicle. This is remedied by means of electric additional heaters that are provided with PTC resistances as heating elements.

Intake air heaters are disclosed, e.g., in DE 195 15 533 C2 and U.S. Pat. No. 6,073,615 A. Additional heaters are disclosed, e.g., in EP 390 219 B1 and in DE 100 49 030 A1.

It is known to control the load current for the operation of the heating elements of such heating devices by means of power semiconductors, e.g., through a repeated connecting and disconnecting by a procedure of pulse width modulation. In the process, currents of typical automobile supply voltage of 12 volts, 24 volts or, in the future, 42 volts with amperages up to the three-figure amps range, namely, above 100 amps, are switched. Thus, operational failures of the heating devices and their control can easily cause a local overheating. Therefore it is necessary to prevent, particularly, sequential results, above all a fire of the heating device or of the wiring in the vehicle that could endanger the vehicle or its occupants. Such dangerous situations must be prevented at all costs. Thus, it is known to electronically monitor the power semiconductors and the operational conditions. A known possibility of the monitoring consists in determining the current flowing through the power semiconductor, i.e., the load current of the electric circuit wherein is arranged the electric heating element, in order to detect a short circuit. The short circuit can occur not only in the load or in a part of the load, in particular in an electric heating resistance, but also in the power semiconductor itself that is used for the control of the power input.

Power semiconductors with integrated temperature protection are already known. They are capable of independently disconnecting in the case of a temperature excursion caused by a short circuit in a heating resistance or in another load. There are even power semiconductors that can determine not only a short circuit but also other failure events by monitoring the current and voltage and comparing them with limiting values. Should they recognize in such a manner an undervoltage, an excess voltage or an overload current, they can independently deactivate themselves.

However, should also the electronic monitoring of the power semiconductors malfunction, it cannot comply with its task to prevent a local overheating and the therefrom resulting malfunctions and damages. A failure cause, the control of which is quite difficult, has been found to be pre-damaged power semiconductors, the damage of which could not be ascertained at the quality control of their manufacture. It was found that the cause of malfunction of a pre-damaged power semiconductor is that its semiconductor material fails, so that it constantly becomes conductive and shortens the load circuit. Should this happen, then the load circuit is constantly subjected to a current that is limited only by the electric resistance of the load itself. The power input can no longer be controlled or disconnected with a power semiconductor damaged in such a manner, even if the monitoring electronics ascertains an excessively high output. The monitoring electronics is powerless against the excessive output because the current path, the damaged power semiconductor, cannot be switched off any longer. The overheating of the power semiconductor can reach over to the printed circuit board on which is arranged the power semiconductor and can overheat the circuit board material, so that the latter generates toxic and/or inflammable gases that could also endanger the vehicle and its passengers. Another consequence could be the burning of the cables in the load current supply system.

Fuses for extremely high current that are known as safety features of load circuits in automobiles are either too slow-blowing or nor sufficiently reliable to bring about a timely interruption of the load current circuit in an electric heating system of the mentioned type.

DE 38 25 897 C2 discloses a thermal fuse for a film integrated circuit. The known fuse has a spring configured as a U or V-shaped strap whose two legs connect two solder points that are provided in a current-carrying circuit und limit a gap therein that is bridged by the spring. The circuit is on a substrate that carrying the integrated film circuit to be monitored. The integrated film circuit is in a good heat-conducting connection with one of the two solder points. The solder points heat up in the case of an overheating. With a well chosen solder, the solder softens before the circuit component to be safeguarded is damaged because of an overheating. A disadvantage is, however, that the spring is subjected to a sustained pretensioning that has the tendency to loosen the spring legs from the solder points. This tendency is strengthened by vibrations, heating and corrosion so that an undesired tripping of the fuse or a tripping at too low a temperature can occur. Such a spurious tripping cannot be cancelled. The integrated film circuit that is to be protected by the fuse cannot operate thereafter although it would be operative.

The present invention has the object to show a manner by means of which an electric circuit can be reliably protected by a fuse, in which circuit are arranged one or several heating resistances as load and one or several power semiconductors controlling the power input. The protection shall be particularly appropriate for electric additional heaters and electric intake air heaters in motor vehicles, be suitable for protecting power semiconductors in the case of their dielectric breakdown or for the fuse protection of a heating element in the case of a short circuit. It is important, however, that the fuse protection must be cost-effective to manufacture, that it is of simple structure and easy to install.

This object is attained by an electric circuit with the features set forth in claim 1. Other advantageous embodiments are object of the dependent claims.

SUMMARY OF THE INVENTION

The electric circuit according to the invention comprises a connection for a current source, an electric load that, in a case of failure, can emit excessive heat, and a thermal-mechanical fuse that, in a case of failure, interrupts the power supply to the load. A case of failure occurs when excessive heat is generated at a point in the circuit, e.g., at the electric load or at a power semiconductor. The current supply is effectuated by means of a feeder in which is arranged a spring with two ends of which at least one of them is soldered to a solder point provided in the feeder. The at least one solder point is under the mechanical pretensioning effected by the spring's restoring force, which separates the soldered connection between the spring and the solder point in the feed line when the solder melts. With an appropriate selection of the solder, the solder melts before the load to be protected can be damaged by overheating. The preloaded spring is loosened from the solder point, thus interrupting the feed line that carries the load current.

According to the invention there is provided a mechanical support that is connected in a heat-conducting manner to the source of an eventual overheating. By source must be understood herein not only a heating element, e.g., a heating resistance but, e.g., also a power semiconductor at which, because of a damage, such a high power loss can set in that it gives raise to an excessive temperature, which is beyond the admissible temperature range. The support is configured in such a manner that, at temperatures that occur in a faultless operation, it absorbs the restoring force of the spring, a restoring force of the spring and therefore reduces the stress of the at least one solder point, at which is soldered the spring. However, the support yields when, because of an operational failure, the solder melts so that, in such a case of failure, the spring can separate from the solder point.

This has several advantages:

- In the case of faultless operation, the support absorbs the restoring force or at least such a portion of the spring's restoring force, so that the spring does not exert a tensile stress on the at least one solder point, to which it is soldered. The support delimits at least the tensile stress exerted upon the solder point to a non-critical value, so that an undesired fault tripping of the fuse can be ruled out.
- By means of the support it is even possible not only to absorb the restoring force of the spring but, beyond that, to pretension the spring against the solder point, so that the spring, under the action of the support, not only pulls at the solder point but even exerts pressure upon it.
- Spurious tripping of the fuse can be precluded.
- Although the spring that protects the current circuit carries current, its protecting characteristic feature is due its mechanical configuration as a spring and to the heat-carrying connection of the solder point and the support to the heat source that, in the case of failure, can result in an overheating. An electric malfunction cannot result in a failure of the fuse protection.
- Because the tripping threshold is essentially determined by the spring's mechanical structure and the thermal conductivity of the spring, and by the composition of the solder, it is variable.
- Since it is not an electric current that trips the fuse, but rather the heat flow generated by the electric component to be monitored, every electric component that has the tendency to overheat in the case of a failure can be protected according to the invention, a heating resistance as well as a power semiconductor controlling the heat resistance.
- The tripping of a fuse protection, according to the invention, is irreversible so that the defective electric component, be it a heating resistance or a group of heating resistances, a heating branch or a power semiconductor controlling the electric power, can no longer cause any danger not even after a restarting of the vehicle.

The support yields to the restoring force of the spring at the latest when the support itself is exposed to the melting temperature of the solder of the at least one solder point or a temperature in the range of the melting temperature of the solder. Depending on the direction of the heat flow and the thermal conductivity of the support compared to the thermal conductivity of the spring and of the solder point it is possible that the temperature of the support lags behind the temperature of the solder point. Moreover, it must be taken into account that frequently solder alloys do not have a melting point but a melting range, so that it would be inappropriate to state for the temperature at which the support yields to the restoring force of the spring, so that it can separate from the solder point, a close relationship to the melting temperature of the solder. Furthermore, it is advantageous that the support is already yielding shortly before the restoring force of the spring, in the absence of the support, would suffice to separate the spring from the heating-up solder point. The advantage is that, when the solder point has reached a temperature at which the solder is so soft or liquid that the restoring force of the spring could separate it from the solder point, this separation occurs then actually very rapidly and is no longer be delayed by a mechanical resistance of the support.

Thus, for the spring to separate from the at last one solder point, it is not absolutely necessary that the solder melts. When approaching the melting range, a progressive softening of the solder occurs so that already in this softening phase it is possible that a separation of the spring from the solder point can take place. Because this is advantageous within the purpose of a reliable protecting in the case of overheating, it is preferable that the support already yields to the restoring force of the spring with the softening of the solder, but at the latest when the temperature at the support itself reaches a point at which the solder softens.

To attain a rapid tripping of the fuse, it is advantageous if the support actuates directly upon the spring and, preferably, as close as possible to the at least one solder point, so that the temperature of the support can follow the temperature of the solder point with the least possible delay.

For the configuration of the support there are a number of possibilities. A first possibility is to make the support either out of a material, or by using one, that melts at the temperature at which the support shall yield to the restoring force of the spring. Therefore, the support can consist of an alloy with a correspondingly low melting point, preferably somewhat lower than the melting range of the utilized solder. By way of example, the support can be formed either by a solder alloy or by using one; this solder alloy could be of a similar composition as the solder alloy used for the solder point; its composition is preferably chosen in such a manner that its melting temperature or its melting range, respectively, is somewhat lower than that of the solder used at the at least one solder point.

For the support can also be used a low-temperature melting alloy that, although it does not melt at the desired temperature, softens to such an extent that that it is deformed under the restoring force of the spring and thereby facilitates the separation of the spring from the solder point.

It is also possible to make the support by using a material that sublimes or disintegrates at the desired temperature if these processes happen in a sufficiently rapid manner. Of general knowledge are materials that rapidly disintegrate when being heated, in particular, organic materials. Thus, synthetic materials can be considered for the support such as, e.g., thermosetting materials, that disintegrate in the desired temperature range, thermoplastic casting resins and, in particular, thermoplastics that soften or melt in the desired temperature range, e.g., polyamides such as polyamide 6, polypropylene or waxy polyethylene having a melting point of about 140° C. Also possible is a support that is formed either out of, or by using, a wax or paraffin that sufficiently softens or even liquefies in the desired temperature range but that, at the regular operating temperature, is sufficiently hard in order to absorb the restoring force of the spring. Materials impregnated with wax or paraffin are a possibility.

Another possibility is to form the support out of, or by using, a material that, when heated, either shrinks by itself or under the effect of the restoring force such as, e.g., a rigid cellular material.

It is not necessary that the support consists entirely out of a material that, at the temperature to which the support is exposed during faultless operation, resists the restoring force but that yields when the solder softens or melts at the one at least solder point. It is also possible to use a composite support that consists of a first support that yields when the solder either softens or melts at the solder point and a second support that supports the first one, and that can resist the restoring force of the spring at a higher temperature than the first support. Such an embodiment of the invention is especially advantageous if the second support is formed by including the second end of the spring. In other words: in this case, the support is mounted—preferably directly—between two opposite spring legs that, by means of the support, are held at a distance against the restoring force of the spring. In connection with one of the solder points assigned to it, each of the two spring legs is concomitantly a support for the opposite leg. In the simplest manner, such a development of the invention is realized with a spring that is bent in such a manner that, when the support is inserted between the legs, it is of U- or V-shaped form.

Should the support be removed from such a spring, the two spring legs come close to each other and could also meet in a resilient manner so that the spring itself is still pretensioned.

The spring can be bent out of a spring wire but preferably it is formed from a spring steel strip. This is beneficial for the forming of the spring and for the fastening of the support between the two spring legs.

Particularly well suited is a spring in which a support is clamped between two legs in order to simultaneously protect two separate electric components or assemblies of which one, e.g., a heating resistance, is allocated to a solder point and the other component, e.g., a power semiconductor, is allocated to a second solder point. The closer the pertinent component or assembly, respectively, which could overheat in the case of a failure, is to its allocated solder point, and the better the thermal conductivity at the route to it, the shorter the response rate. The spring is preferably arranged with at least one solder point directly in a feed line carrying a load current between two such components or assemblies, especially between a power semiconductor and one of the electric heaters controlled by it. It is even possible to choose different solder alloys for the two solder points, so that the solder points respond at different temperatures. However, this is only to be recommended if the difference between the response temperatures is not that high that only the solder point responds at the lower response temperature regardless from which side of the spring comes the heat flow.

For the spring is recommended a material out of an alloy that combines the desired spring quality with a good wettability for the solder and a high electric conductivity. An especially suitable example is the alloy CuNi1Co1Si, i.e., an alloy out of 1% by weight nickel, 1% per weight cobalt, less than 1% per weight silicon, and copper the rest. Concomitantly with its high electric conductivity, the alloy has a high thermal conductivity.

The support is preferably formed as a strut, in particular as a rod or pin, which absorbs the restoring force of the spring in its longitudinal direction. The support is installed only after the soldering of the spring to at least one solder point. In order to hold the support, a recess or a hole is stamped or provided in at least one of the legs to spring-clamp the pertinent end of the support.

A soft solder is suitable as solder to be used for the soldering of the spring to its pertinent solder point. It is possible to use leaded as well as non-leaded soft solders. Especially suitable is a solder of the group S—Sn60Pb38Cu2 having a melting temperature between 183° C. and 190° C., S—Sn96Ag4 having a melting temperature of approx. 221° C. and S—Sn97Ag3 having a melting temperature of 221° C. to 230° C.

BRIEF DESCRIPTION OF THE DRAWINGS

Embodiments of the invention are illustrated in the accompanying drawings. The identical parts or parts corresponding to each other in the embodiments are indicated by the same reference numbers.

DETAILED DESCRIPTION

Figure 1:
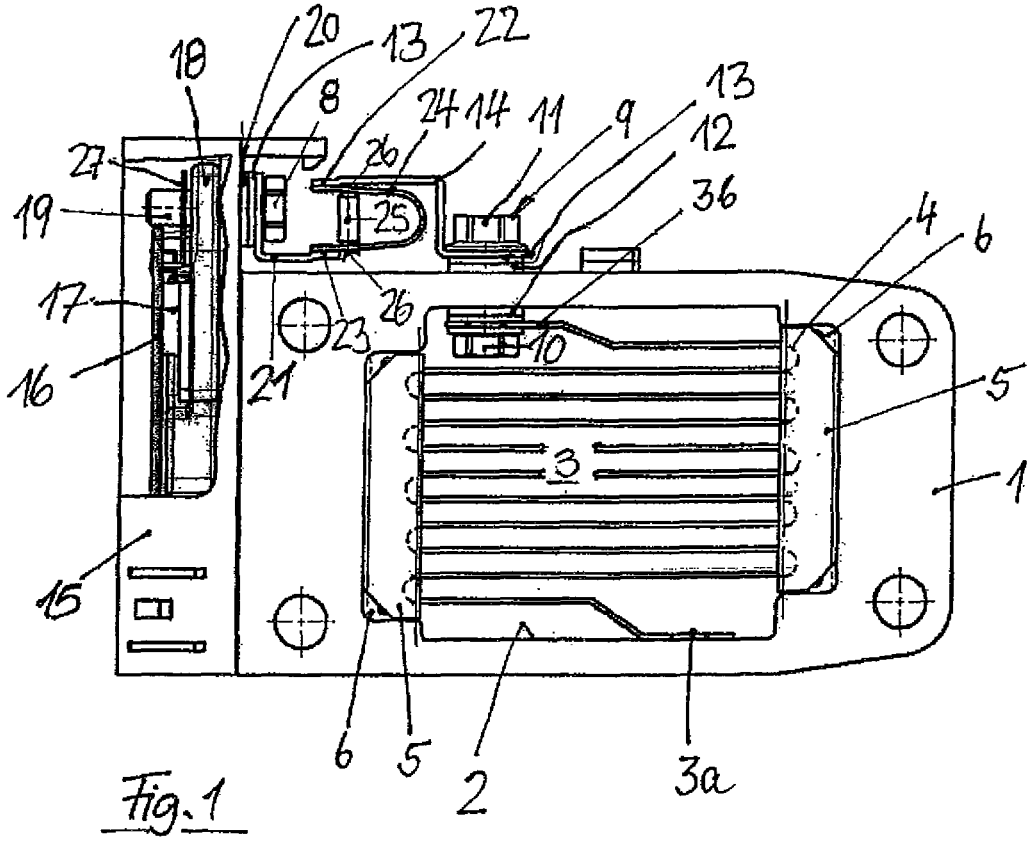
FIG. 1 shows a lateral view of an electric heating system for a preheating of the air in an intake port of an internal combustion engine with a thermal-mechanical fuse, configured according to the invention.

The heating system illustrated in FIG. 1 is provided with a solid frame 1 surrounding an aperture 2 wherein is arranged a metal band-shaped heating element 3. The heating element extends in a meander-shaped manner. The turns 4 of the meander are illustrated merely by a broken line since they are located in a structural part 5 wherein are ceramic supporting elements that support the heating conductor 3 on its turns 4. Two of such structural parts 5 are arranged in two opposite cutouts 6 and 7 of the frame 1.

The one end 3*a* of the heat conductor 3 is connected to the frame 1 and is connected to ground potential. The other end 3*b* of the heating conductor is fastened to a screw terminal 9 that is electrically insulated attached to the frame 1. The screw terminal 9 consists of a screw 10 that is passed through the frame 1, a nut 11 that is screwed on to the screw 10, an insulation 12, and two washers 13. A rolled-out bus bar 14 is affixed to the terminal 9 on the outside of the frame 1. The bus bar 14 is part of the feeder to the heating conductor 3.

On the side of the frame 1 is provided a housing 15 with its wall partly broken off. Inside the housing 15 is arranged a control circuitry for the controlling of the heating power of the heating conductor 3. This control circuitry comprises a printed-circuit board 16 that is equipped with a power semiconductor 17 that gives off its waste heat to a heat sink 18 which is screwed on to the frame 1. For this is used a screw 19 that is a component of a second screw terminal 8 that is electrically insulated attached to the frame 1 by means of an insulator 20. The screw terminal 8 serves concomitantly as a connection terminal for another rolled-out bus bar 21 which is also a component of the feeder to the heating conductor 3. The bus bar 21 is fed the load current by the power semiconductor 17. For this purpose, the screw 19 is connected by means of a connecting flange 27, conveying the load current to the load current output of the power semiconductor 17 on the printer-circuit board 16.

Each of the two bus bars 14 and 21 has an end 22, 23, bent off, which are parallel opposite to each other, and have solder points for a spring 24 bent to a U-shaped strap. The spring 24 is made out of a spring-steel sheet strip. The ends of the two legs 24*a*, 24*b* of the spring 24 are connected under mechanical pretension to the solder points 22 and 23. In such a manner, the spring 24 bridges the gap between the bus bars 14 and 21. The pretension is oriented in such a manner that the legs 24*a* and 24*b* of the spring 24 tend to move towards each other, so that tension is applied to the solder points 22 and 23. The restoring force of the spring 24, that exerts the tension on the solder points 22 and 23, is absorbed by a pin-shaped support 25 that is clamped next to the solder points 22 and 23 between the legs 23*a* and 24*b* of the spring 24. The spring 24 has two opposite holes 26 at the point of fixation, which holes are either drilled or punched into the two legs of the spring 24. The pin-shaped support 25 with conical- or ball-shaped ends is spring-mounted in these holes 26.

For assembly the spring 24 is inserted and soldered spread between the solder points 22 and 23. The spreading is maintained until the solder is cooled down. Once the spring 24 is sufficiently cooled down, the pin-like support is inserted, whose correct seat is easily recognizable when engaging it in the holes 26. After the insertion of the support 25, the tool by means of which the spring 24 was spread is removed.

Figure 2:
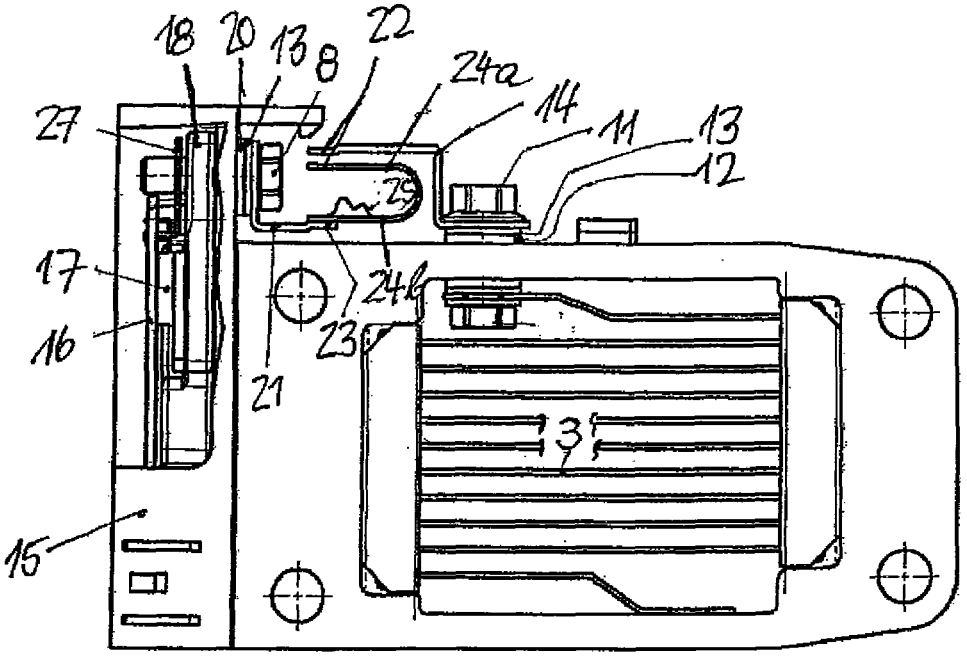
FIG. 2 shows the heating system as in FIG. 1 after the response of the fuse.

Should an overheating occur at the heating element 3, this overheating propagates via the screw terminal 9 and the bus bar 14 to the solder point 22 and heats it. The heat flows from the solder point 22 via the spring 24 to the support 25. So that an overheating can be rapidly detected, the screw terminal 9, the bus bar 14 and the spring 24 are made out of a good heat conducting material, especially out of copper or copper based alloys, respectively. The temperature of the support 25 follows the temperature of the solder point 22. When the solder at the solder point 22 softens or melts, the temperature of the support 25 has also increased to such an extent that it cannot any longer withstand the restoring force of the spring 24, whose one leg 24*a* is no longer held fast by the solder point 22 because the support 25 either melts, collapses or gives way in another manner. Preferably, the support 25 loses its resistance and releases the spring 24 even before the temperature of the solder point 22 suffices to separate the spring 24 from the solder point 22. Should this temperature be reached subsequently, the separation takes place without any delay. FIG. 2 illustrates the condition after the separation. The leg 24*a* of the spring 24 has become lose from the solder point 22; the load current from the power semiconductor 17 to the heating resistance 3 is permanently interrupted.

In the case of a failure of the power semiconductor 17, e.g., because of a dielectric breakdown of the power semiconductor 17, it would generate an increased waste heat which, above all, reaches the screw 19 via the heat sink 18 and then via the bus bar 21 the solder point 23. The screw 19 and the bus bar 21 are also preferably made out of copper or out of a copper alloy. The solder point 23 is heated, the temperature of the pin-shaped support 24 follows the temperature of the solder point 23 and eventually occurs the collapsing of the support 24 and subsequently, by softening or melting of the solder of the solder point 23, the separation of the leg 24*b* of the spring 24 from the solder point 23. Accordingly, the thermal-mechanical fuse that is constituted by the spring 24 in conjunction with the pin-shaped support 25 protects the heating system in two manners, namely against an overheating that is generated by the heating conductor 3 as well as against an overheating generated by the defective power semiconductor 17.

Figure 3:
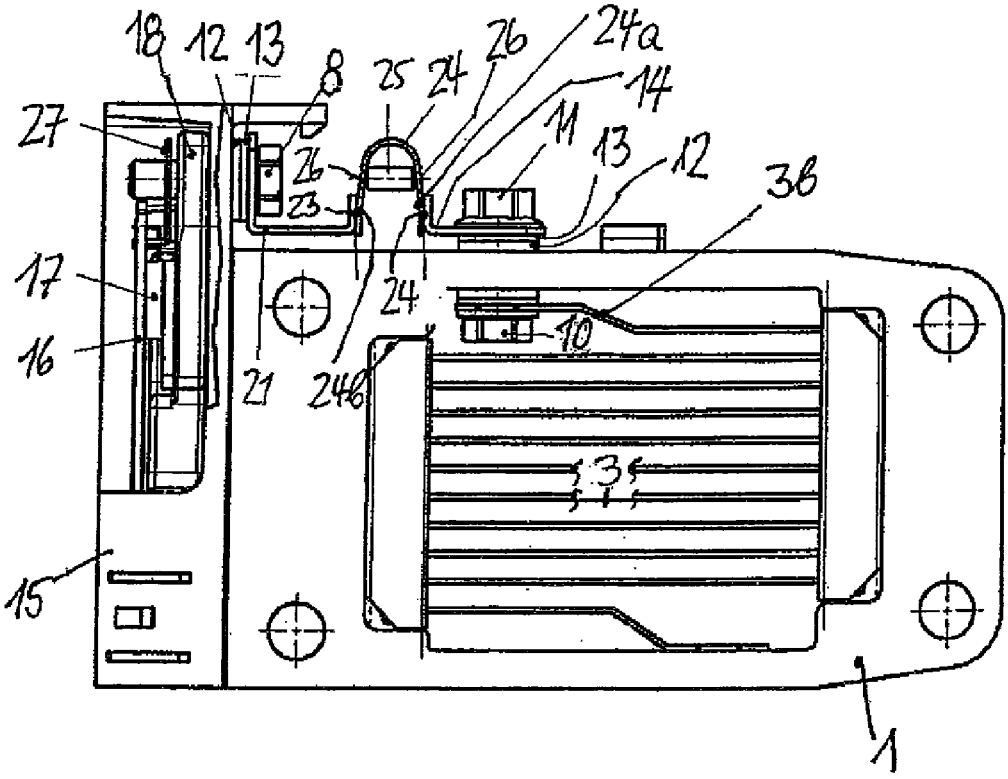
FIG. 3 shows a heating system as in FIG. 1 but with a different installation position of the fuse.
Figure 4:
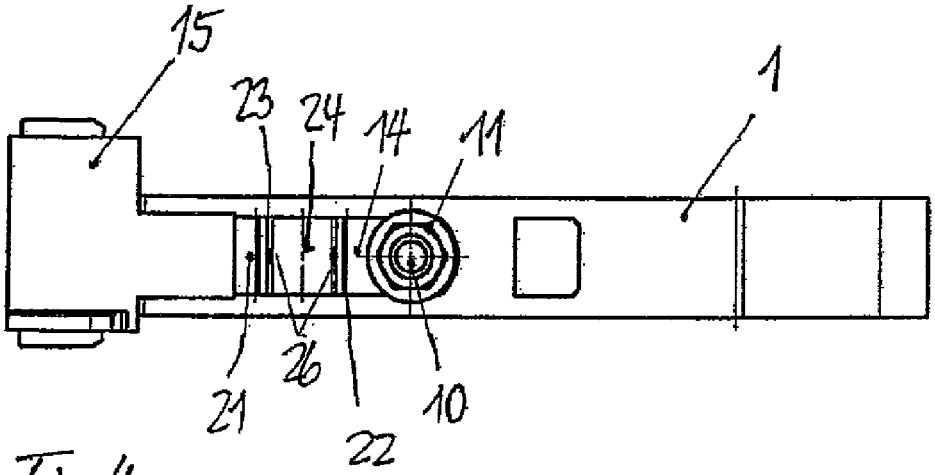
FIG. 4 shows a top view of the heating system as in FIG. 3.
Figure 5:
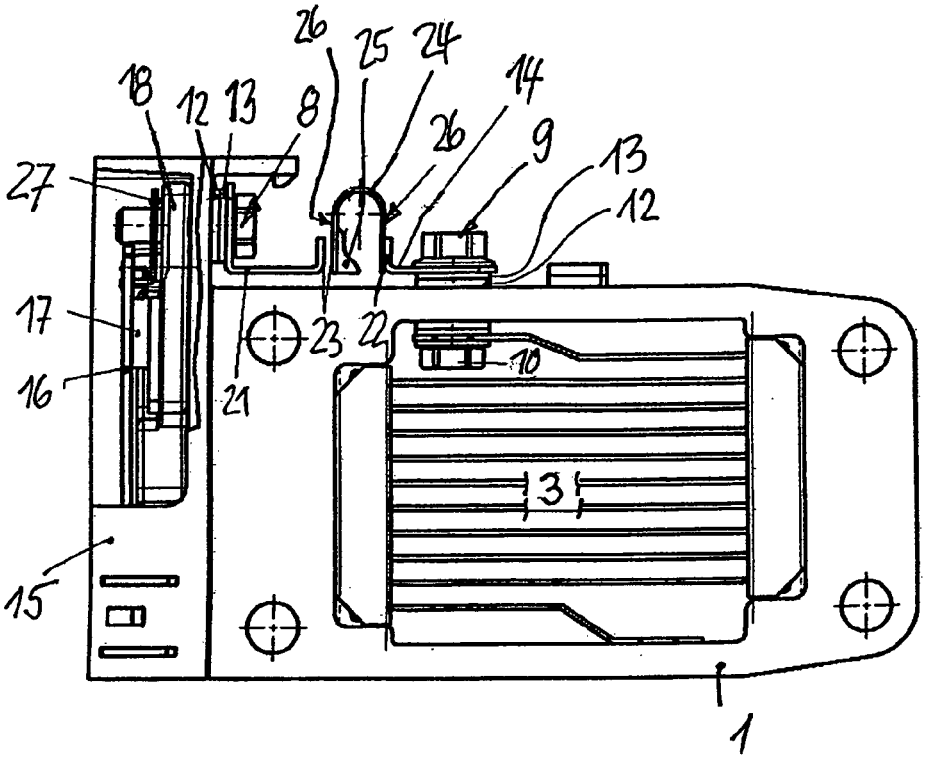
FIG. 5 shows the heating system as in FIG. 3 after the tripping of the fuse.

The embodiment illustrated in FIGS. 3 to 5 differs from the embodiment illustrated in FIGS. 1 and 2 only in that the spring 24 is mounted in a 90° changed position. This requires a different configuration of the bus bars 14 and 21. In all other aspects, the design and the operation of the heating system and its fuse are unchanged.

The fuse shown in the illustrated examples can also be used in an additional heating system, preferably as a contact breaker of a bus bar leading from a power semiconductor to the PTC heating elements.

By way of example, the power semiconductors can be MOSFET alloy semi conductors.

Figure 6:
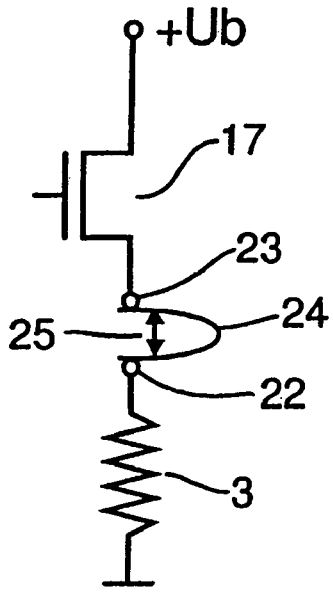
FIG. 6 shows the electric circuit diagram of both heating systems.

FIG. 6 shows the circuit diagram of the two afore-described examples of a heating system. The path of the current flows from a battery clamp with a voltage of $+U_B$ through a power semiconductor 17, through the spring 24 with both of its solder points 23 and 22, and through the load 3—the heating resistance—to a grounding terminal.

Reference Numbers List

1 Frame
2 Aperture
3 Heating conductor, load
3*a* End
3*b* End
4 Turn
5 Structural part
6 Cutout
7 Cutout
8 Screw terminal
9 Screw terminal
10 Screw
11 Nut
12 Insulation
13 Washer
14 Bus bar, part of a feed line to the load
15 Housing
16 Printed-circuit board
17 Power semiconductor
18 Heat sink
19 Screw
20 Insulator
21 Bus bar, part of a feed line to the load
22 Solder point
23 Solder point
24 Spring
24*a* Leg of the spring, second support
24*b* Leg of the spring, second support
25 Support
26 Holes
27 Connecting flange

What is claimed is:

1. An electric circuit comprising:

a connection for a current source;

an electric load;

a thermal-mechanical fuse for interrupting a current feed to the load, the fuse comprising:

a spring having two ends, at least one of the ends being soldered to a solder point on a bus bar, the solder point being under mechanical pretension by a spring restoring force, the pretension separating the soldered joint between the spring end and the solder point when the solder melts at the solder point; and a thermosensitive mechanical spring support connected in a heat conducting manner with a heat source, disposed between the spring ends and withstanding the spring restoring force at temperatures that occur at the support during faultless operation of the electric circuit, but yielding, due to the increase of said temperatures, to the spring restoring force when the solder at the solder point melts for enabling spring separation from the solder point.

2. An electric circuit according to claim 1, wherein the support yields to the restoring force of the spring when it is subjected to a temperature at which the solder melts at the solder point.

3. An electric circuit according to claim 1, wherein the support already yields at the moment when the solder softens at the solder point and the restoring force of the spring separates the solder joint.

4. An electric circuit according to claim 1, wherein the support already yields to the restoring force of the spring at the moment at which it is subjected to a temperature at which the solder softens at the solder point.

5. An electric circuit according to claim 1, wherein the support is made out of a material, or by using such a material, that yields insofar as it melts, softens, sublimates, decomposes, shrinks, or deforms.

6. An electric circuit according to claim 1, wherein the support is made out of or by the use of a synthetic material.

7. An electric circuit according to claim 1, wherein the support is a strut.

8. An electric circuit according to claim 1, wherein the spring is bent in a U- or V-shaped manner.

9. An electric circuit according to claim 1, wherein the spring is made out of a strip-shaped spring steel sheet.

10. An electric circuit according to claim 1, wherein the spring is made out of CuNi1Co1Si.

11. An electric circuit according to claim 1, wherein the solder is a soft solder.

12. An electric circuit according to claim 1, wherein the spring is arranged with respect to the path of the current between a power semiconductor for controlling power input of the load and the load.

13. An electric circuit according to claim 12, wherein the spring is positioned also spatially between the power semiconductor and the load.

14. An electric circuit according to claim 1, wherein the load is a heating resistance.

* * * * *